US005689836A

United States Patent [19]

Fee et al.

[11] Patent Number: 5,689,836

[45] Date of Patent: Nov. 25, 1997

[54] ATHLETIC PROTECTIVE UNDERGARMENT

[75] Inventors: Terence Michael Fee, Clarendon Hills; Robert Finley McDavid, III, Downers Grove, both of Ill.

[73] Assignee: McDavid Knee Guard, Inc., Chicago, Ill.

[21] Appl. No.: 806,649

[22] Filed: Feb. 26, 1997

Related U.S. Application Data

[63] Continuation of Ser. No. 593,109, Feb. 1, 1996, abandoned, which is a continuation of Ser. No. 294,159, Aug. 22, 1994, abandoned.

[51] Int. Cl.[6] ..... A41D 13/00

[52] U.S. Cl. ..... 2/465; 2/22

[58] Field of Search ..... 2/2, 267, 23, 22, 2/404, 407, 400, 227, 455, 465

[56] References Cited

U.S. PATENT DOCUMENTS

| | | | |
|---|---|---|---|
| Re. 34,573 | 4/1994 | Calvert | 2/267 X |
| 222,921 | 12/1879 | Lowenberg . | |
| 467,818 | 1/1892 | Logan et al. | 2/248 |
| 759,833 | 5/1904 | Stall | 2/23 |
| 883,475 | 3/1908 | Ortell | 2/247 |
| 891,977 | 6/1908 | Bloch . | |
| 1,406,794 | 2/1922 | Whitley | 2/22 X |
| 1,573,212 | 2/1926 | Whitley et al. . | |
| 1,602,454 | 10/1926 | Riddell . | |
| 1,915,754 | 6/1933 | O'Shea . | |
| 2,165,081 | 7/1939 | Wald . | |
| 2,249,966 | 7/1941 | Matthews . | |
| 2,519,126 | 8/1950 | Falk | 2/247 |
| 2,629,094 | 2/1953 | Goldsmsith . | |
| 2,774,073 | 12/1956 | Herbener . | |
| 2,800,663 | 7/1957 | Falk . | |
| 2,902,694 | 9/1959 | Falk | 2/247 |
| 2,930,046 | 3/1960 | Sagner . | |
| 3,295,530 | 1/1967 | Mayer et al. . | |
| 3,310,053 | 3/1967 | Greenwood . | |
| 3,484,868 | 12/1969 | Davenport, Jr. . | |
| 3,515,142 | 6/1970 | Black . | |
| 3,751,731 | 8/1973 | Bennett | 2/227 |
| 3,909,847 | 10/1975 | Holt et al. | 2/2 |
| 4,089,064 | 5/1978 | Chandler, Jr. | 2/2 |
| 4,267,607 | 5/1981 | Tino . | |
| 4,292,263 | 9/1981 | Hanrahan et al. | 2/23 X |
| 4,428,080 | 1/1984 | Takamatsu | 2/227 |
| 4,455,686 | 6/1984 | Zide | 2/23 |
| 4,462,115 | 7/1984 | Carlson et al. | 2/2 |
| 4,479,269 | 10/1984 | Balliet | 2/23 |
| 4,507,801 | 4/1985 | Kavanagh et al. | 2/2 |
| 4,700,407 | 10/1987 | Mattila | 2/23 |
| 4,805,243 | 2/1989 | Gibbens et al. . | |
| 4,875,240 | 10/1989 | Barrett | 2/227 |
| 4,890,337 | 1/1990 | Greenberg . | |
| 4,894,867 | 1/1990 | Ceravolo et al. | 2/23 X |
| 4,987,613 | 1/1991 | Loverdi et al. | 2/267 X |
| 5,033,117 | 7/1991 | Fairweather . | |
| 5,105,473 | 4/1992 | Valtakari | 2/2 |
| 5,161,257 | 11/1992 | Arensdorf et al. | 2/2 |
| 5,271,101 | 12/1993 | Speth et al. | 2/267 X |
| 5,361,410 | 11/1994 | Sigl | 2/267 X |
| 5,365,610 | 11/1994 | Lubahn et al. | 2/267 X |
| 5,423,087 | 6/1995 | Krent et al. | 2/267 X |

*Primary Examiner*—Paul C. Lewis

*Attorney, Agent, or Firm*—Fitch, Even, Tabin & Flannery

[57] ABSTRACT

A protective undergarment includes trousers of stretch fabric. Pads located inside the trousers are sewn to the trouser sides. The pads include laminated layers of fabric and a foam substrate. The foam substrate is perforated to augment air circulation and evaporative cooling of the wearer's skin.

16 Claims, 4 Drawing Sheets

ATHLETIC PROTECTIVE UNDERGARMENT

This is a continuation of application Ser. No. 08/593,109, filed Feb. 1, 1996, now abandoned, which is a continuation of application Ser. No. 08/294,159, filed Aug. 22, 1994, now abandoned.

BACKGROUND OF THE INVENTION

1. Field of the Invention

The present invention pertains to protective garments, and in particular to protective garments suitable for athletic use.

2. Description of the Related Art

Protective garments, for use in athletic events such as football, have been available for some time. So-called football pants have evolved to include pockets for holding rigid or at least semi-rigid protective plates. Such garments are typically bulky, significantly increasing a wearer's silhouette, thereby requiring special construction details to prevent injury to a wearer when the bulging parts of the garment undergo a shear action as when the wearer slides along the playing field. Such garments have been found to provide effective protection for a wearer, but, because of their bulk and movement restriction, are unsuitable for other athletic events, such as baseball, soccer or volleyball. Further, football pants and the like comprise outer garments forming a visible part of a player's uniform.

It is desirable to provide lightweight, nonbulky protective apparel for use in a wide variety of sports, underneath a player's outer garments, so as not to interfere with a player's uniform or outer appearance on the playing field.

SUMMARY OF THE INVENTION

It is an object of the present invention to provide a protective garment in the form of either long pants or short trousers (or "shorts"), which extend from a wearer's waist to an area generally adjacent the wearer's knees.

Another object of the present invention is to provide protective garments of the above-described type which are stretchable and which are relatively thin so as to be worn underneath a wearer's trousers.

Yet another object of the present invention is to provide protective garments of the above-described type offering improved cooling of a wearer's skin during an athletic event.

These and other objects according to principles of the present invention are provided in an athletic protective undergarment, capable of being worn under a pair of pants, for protecting a wearer's hip and thighs while providing freedom of movement, air circulation and evaporation of perspiration comprising:

- trousers of easily stretchable and expandable fabric that draws perspiration away from a wearer's skin;
- a pair of pads, each comprising a layer of fabric that draws perspiration away from the wearer's skin, laminated to a foam substrate, the pads dimensioned to cover the wearer's hips and laterally projecting portions of the wearer's thighs;
- attaching means for nonremovably attaching the pads to laterally projecting portions of the trousers; and
- the foam substrate is perforated to augment air circulation and evaporative cooling of the wearer's skin.

DETAILED DESCRIPTION OF THE PREFERRED EMBODIMENT

Figure 1:
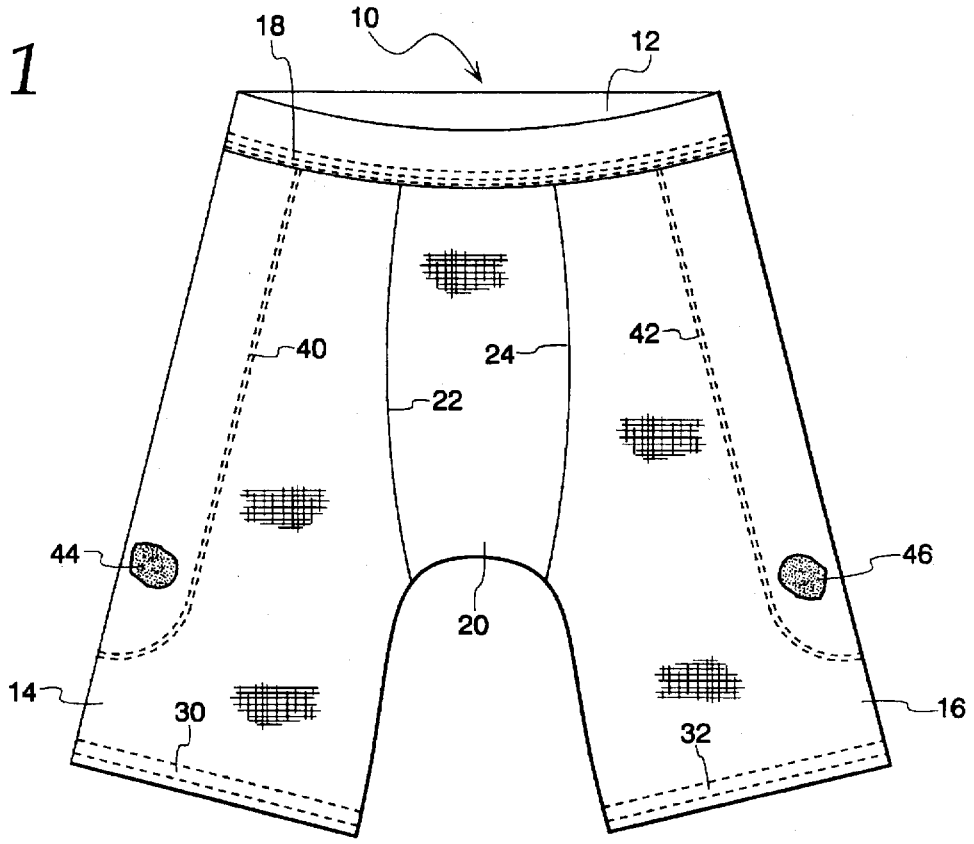
FIG. 1 is a front view of a garment according to principles of the present invention.
Figure 2:
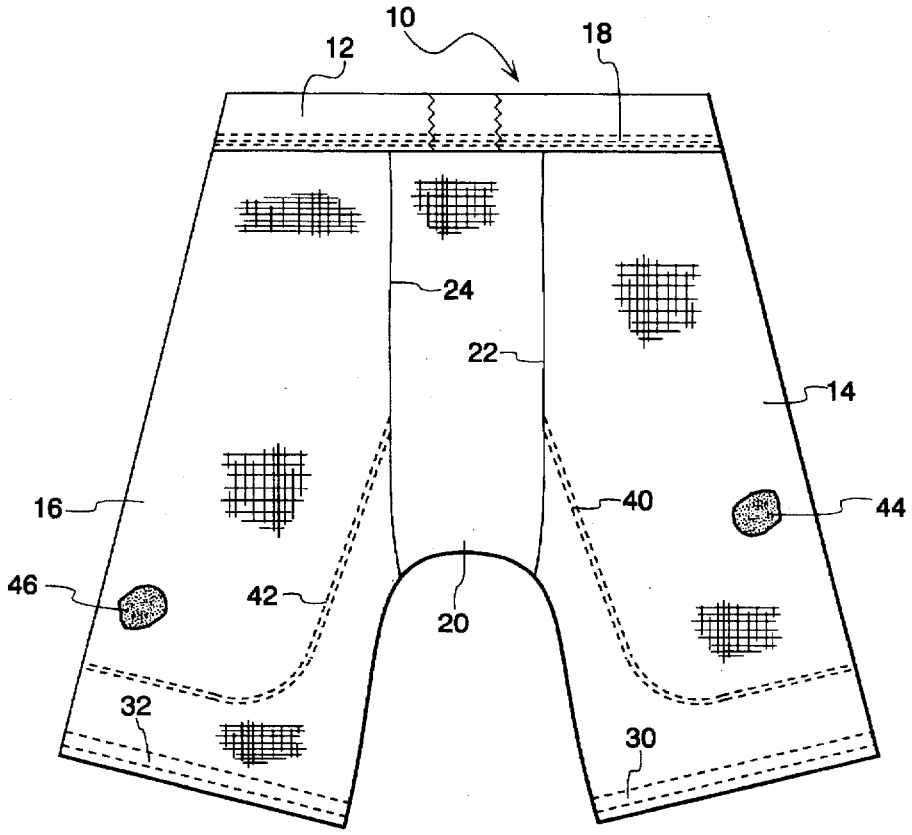
FIG. 2 is a rear view thereof.

Referring now to the drawings, and initially to FIGS. 1 and 2, a protective garment according to principles of the present invention is generally indicated at 10. Garment 10 includes a waistband 12 sewn to first and second legs or trouser portions 14, 16 by stitching 18. The trouser portions 14, 16 are joined together by an intermediate panel 20 sewn to the trouser portions along stitched seams 22, 24 which extend between spaced portions of waistband 12. The trouser portions 14, 16 and intermediate panel 20 are made of synthetic fabric which is readily stretchable and expandable, preferably comprising expandable nylon/SPANDEX warp knit fabric treated with an INTERA process available from Intera Company, Limited. The treated fabric is available from Darlington company located in Augusta Ga. In describing characteristics of the preferred treated fabric, the fabric is said to have "four-way stretch", being capable of substantial stretching in different coplanar directions (e.g. perpendicular or other nonparallel directions taken along the plane of the fabric). While most fabrics "stretch" to some extent, the fabric from which the trousers and intermediate panel are formed has a much greater extent of stretching. For example, certain "non-stretch" fabrics may expand on the order of 10% to 20% when placed under substantial tension, oftentimes greater than that experienced under normal wearing conditions. The present invention, however, contemplates fabric which readily stretches 50% to 200% when tensioned under normal wearing conditions.

While the preferred embodiment of the trouser portions and intermediate panel have so-called "four-way stretch," the present invention also contemplates trouser fabric having so-called "two-way" stretch, i.e., stretch in opposite (parallel) directions along a common direction line. As understood, so-called "four-way stretch" fabrics are typically made of artificial fibers woven with a warp knit and so-called "two-way stretch" fabrics are typically made of artificial fibers woven with a circular knit.

The fabric of the trouser portions and intermediate panel may comprise virtually any type of treated artificial fibers, and preferably comprise a combination of nylon and LYCRA or alternatively nylon and polyester. In the preferred embodiment, the fabric is made of 85% nylon and 15%

LYCRA, although the present invention contemplates virtually any knit of artificial fibers. The untreated synthetic fabric used for the trouser portions 14, 16 and intermediate panel 20 is "breathable", drawing perspiration away from the skin so as to promote rapid evaporation, thereby providing an efficient reduction in body heat. In the preferred embodiment, the fabric is treated with the INTERA process of the Intera Company, Limited so as to enhance its ability to promote rapid evaporation of perspiration.

The trouser portions 14, 16 are finished at their lower ends by stitched seams 30, 32, respectively. The seams 18, 22, 24, 30 and 32 are readably stretchable in the direction of their length, and preferably have a zig-zag configuration, as can be seen in the inside-out views of FIGS. 3 and 4. Also visible in FIG. 1 are stitched seams 40, 42 in the trouser portions 14, 16 for internal, permanent padding, as will be described herein. The outer surface of the trouser portions 14, 16 are preferably continuous and unbroken, as is also true of the medial panel 20.

Figure 3:
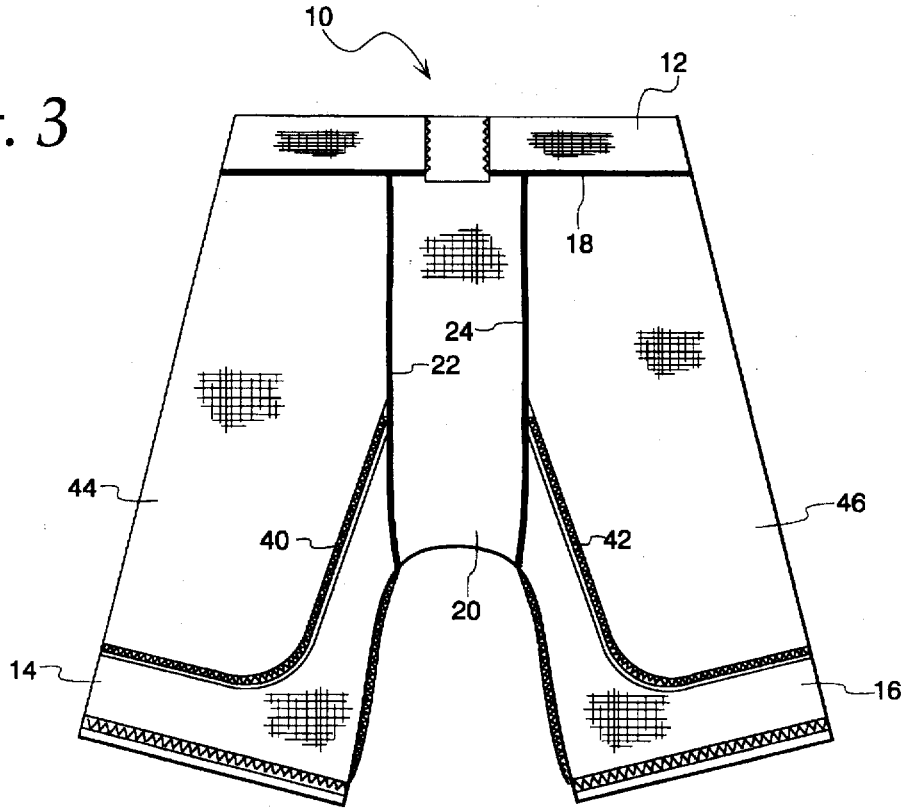
FIG. 3 is a view similar to that of FIG. 2, but with the garment turned inside-out.
Figure 4:
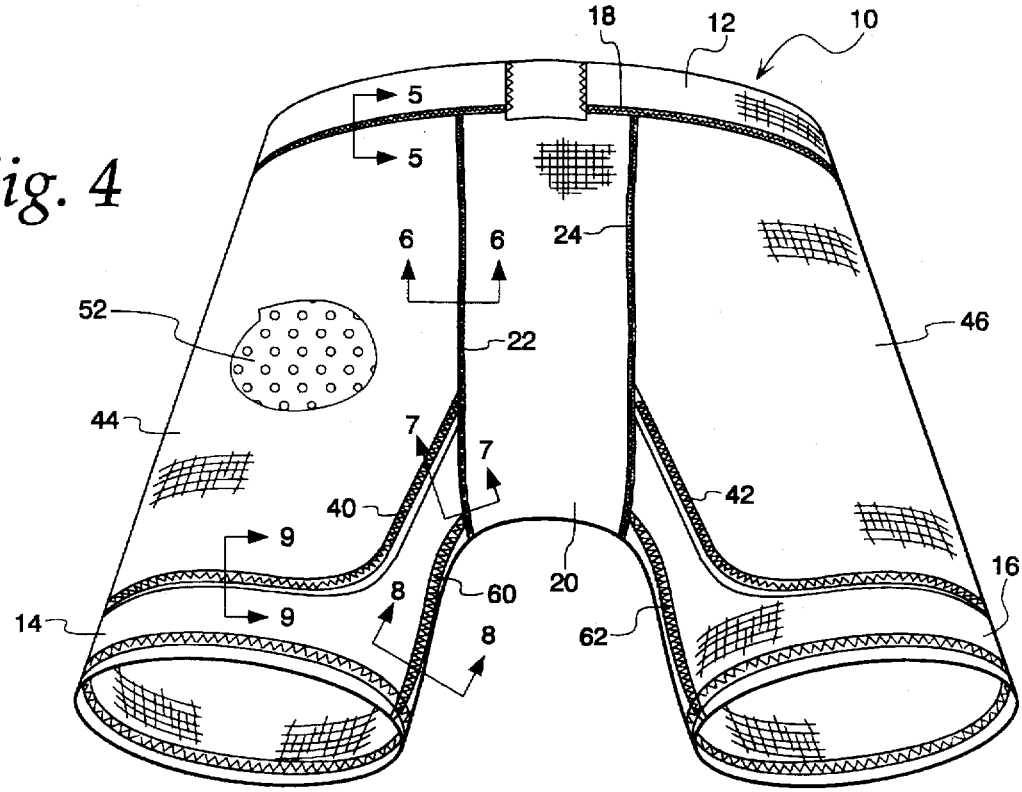
FIG. 4 is a view similar to that of FIG. 3, but showing the garment in a slightly elevated position, and partially broken away.

Turning now to FIGS. 3 and 4, the garment 10 is shown turned inside-out to reveal a pair of protective pads 44, 46 attached to trouser portions 14, 16 by J-shaped stitched seams 40, 42, respectively. As can be seen in FIGS. 1–4, the protective pads 44, 46 are dimensioned and positioned so as to cover the wearer's hips, and laterally projecting portions of the wearer's thighs. The trouser portions 14, 16 are preferably dimensioned so as to end slightly above the wearer's knees, and, in the preferred embodiment, there is a substantial spacing between the protective pads 44, 46 and the lower ends of the trouser portions 14, 16.

Figure 10:
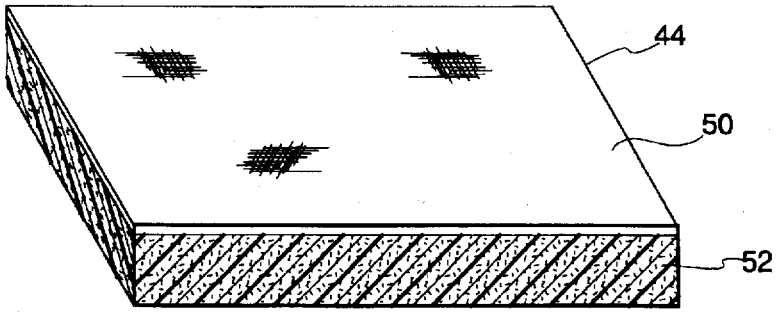
FIG. 10 is a fragmentary perspective view of a portion of the pad visible in FIG. 4.
Figure 11:
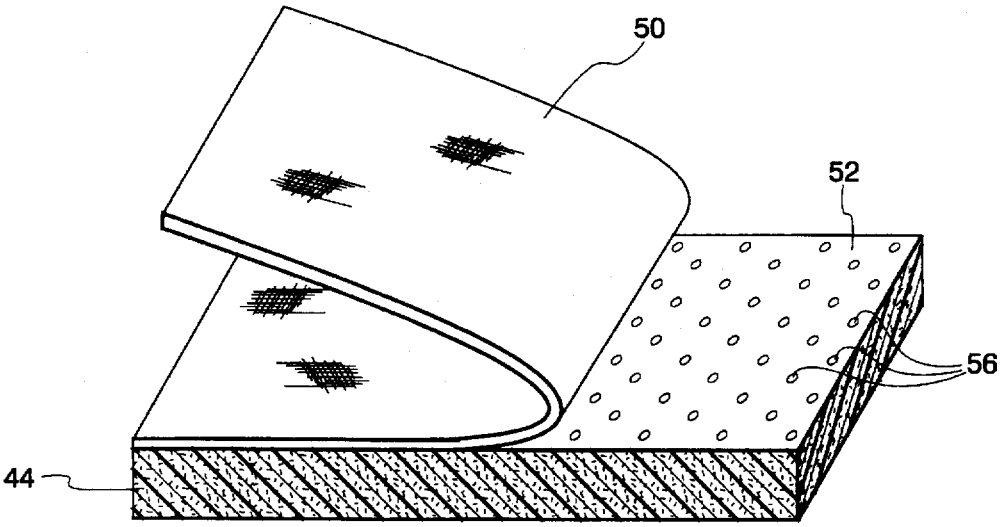
FIG. 11 is a perspective view similar to that of FIG. 10, but showing the pad partially delaminated.
Figure 12:
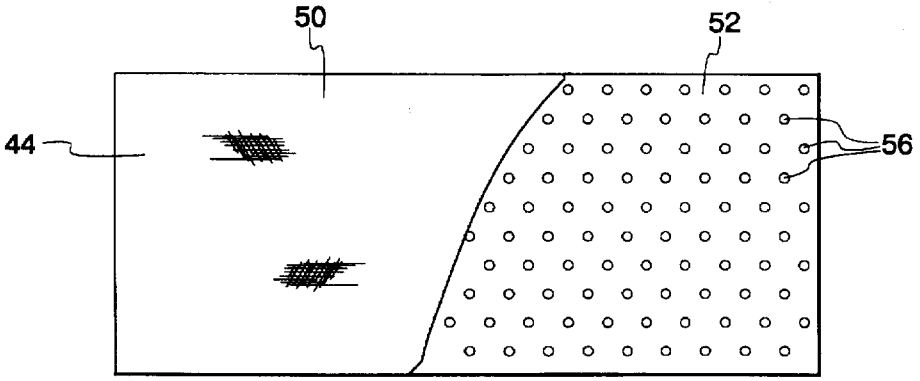
FIG. 12 is a top plan view of the pad fragment of FIG. 11.

Turning now to FIGS. 10–12, the protective pad 44 comprises the assembly of a fabric-backing layer 50 and a foam substrate 52. The fabric-backing layer 50 is comprised of easily stretchable and expandable fabric, preferably having stretch characteristics similar to those of the trouser portions. For example, the stretch characteristics under consideration include the amount of elongation for a given amount of applied tension, and further include the type of stretch behavior (either "four way" or "two way" stretch characteristics described above). The fabric-backing layer 50 preferably matches the "four way" or "two way" characteristics of the trousers fabric, but in less preferred embodiments, the amount of stretch for a given applied tension can vary somewhat. Optionally, the fabric-backing layer can be treated to improve its ability to draw perspiration away from the wearer's skin.

The foam substrate 52 is preferably comprised of neoprene or butyl foam, although other stretch materials such as closed cell foam could also be employed. In the preferred embodiment, the foam substrate is comprised of one of two materials available from Rubatex Company located in Bedford, Va. For white colored garments, a butyl foam, available as Catalog No. R-1300-B, is preferred. For color garments, a neoprene foam, available as Catalog No. R-1400-N, is preferred. These preferred foam materials have stretch characteristics complementing those of the trouser portion. For example, both the neoprene and butyl foam materials referred to herein exhibit so-called four-way stretch, similar to that of the preferred expandable artificial fiber knit material described above for the trouser portions. Thus, a given tension applied to the completed garment will stretch the knit fabric and protective pad component by similar, preferably equal, amounts. Of course, a "four-way" stretch pad would complement the less preferred "two-way" stretch trouser fabric, and this combination would also yield acceptable results.

According to one aspect of the present invention, the foam substrate 52 is perforated with a series of holes 56 which pass entirely through the foam substrate. The fabric-backing and foam substrate layers are preferably laminated together using conventional techniques such as thermosetting adhesives. Support pads 44, 46 are preferably of identical construction.

In the preferred embodiment, the support pads 44, 46 are positioned so that the foam substrate layer contacts the trouser portions, with the fabric-backing layer 50 contacting the wearer's skin. Preferably, the fabric of layer 50 is "breathable" and draws perspiration away from the skin so as to promote rapid evaporation, efficiently reducing body heat. Perspiration is absorbed by the foam layer 52 with an inherent wicking action, and also as a result of repeated flexure and expansion/compression cycles, any moisture is carried to the trouser portions 14, 16. The trouser portions are constructed of material which draws perspiration away from the foam substrate, thereby providing an efficient cooling of the wearer's skin. The introduction of perforations in the foam substrate has been found to provide improved cooling despite the fact that the fabric of the trouser portions and of the backing layer 50 are very tightly woven relative to the dimensions of the foam substrate (that is, not only the pores present throughout the foam substrate, but also of the perforations 56). The spacing between threads comprising the fabric of the trouser portions 14, 16 is much smaller than the dimensions of the perforations 56. In the preferred embodiment, the perforations 56 range in size between 0.02 inch and 0.05 inch, and are preferably less than 0.05 inch.

As indicated in FIGS. 11 and 12, a substantial number of perforations are formed in the foam substrate. In the preferred embodiment, there are approximately 67 holes per square inch, with the spacing between adjacent perforations ranging between 0.125 and 0.188 inch. Other spacings, aperture dimensions and aperture densities can be used, and are contemplated by the present invention. It is most preferred that the foam substrate have at least 60 perforations per square inch.

The support pads 44, 46 have a total thickness less than a quarter inch, preferably less than one-eighth inch and most preferably about 3/32nd inch thickness, when uncompressed. The perforations 56 are believed to improve the wicking of the foam substrate, and also to promote air circulation to the wearer's skin. However, the addition of perforations 56 is found to provide a noticeable improvement in wearer comfort and, through lowering of body temperature, has aided in improving performance in more strenuous athletic events.

As can be seen in FIGS. 1–4, the support pads 44, 46 have front edges substantially spaced from medial panel 20. It has been found convenient to terminate the rear portion of the support pads with the stitched seams 22, 24 at the back of the garment, as shown for example in FIGS. 2–3. The garment according to principles of the present invention has found immediate commercial application to provide protection in athletic events which involve sliding contact with a playing surface, such as base running in baseball, for example. As mentioned above, the support pads 44, 46 are relatively thin so as to exhibit no noticeable bulging, especially when worn underneath a player's trousers. Accordingly, any risk associated with snagging an edge of the support pads, pushing such exposed edge into the player's anatomy, is avoided. Because of the stretchable characteristic of the trouser fabric, the support pads are held against a wearer's skin and maintained in place by so-called "hoop" stresses created by expanded trouser material.

The outer surface of the trouser fabric provides a slidable contact surface with a wearer's outer trousers, thus allowing some relative movement between the outer trousers and the support garment 10 when a wearer comes in sliding contact with the ground, for example, even though the outer trousers are wet. This slidable contact between the inner protective garment 10 and a wearer's outer garment is attributed to the relatively tight weave of and smoother outer finish of the trouser fabric. This feature, however, could be eliminated, if desired.

Figure 5:
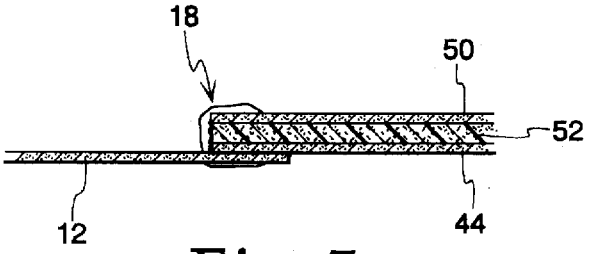
FIG. 5 is a fragmentary cross-sectional view taken along the line 5—5 of FIG. 4.
Figure 6:
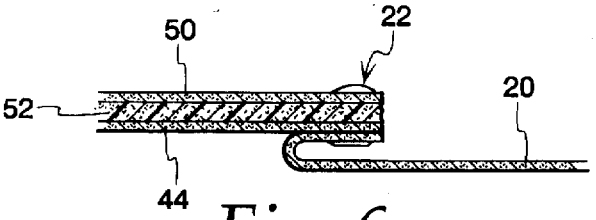
FIG. 6 is a fragmentary cross-sectional view taken along the line 6—6 of FIG. 4.
Figure 7:
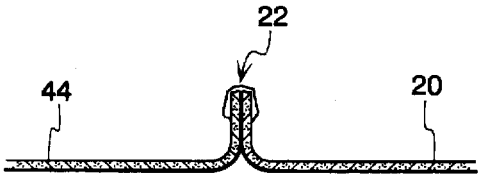
FIG. 7 is a fragmentary cross-sectional view taken along the line 7—7 of FIG. 4.
Figure 8:
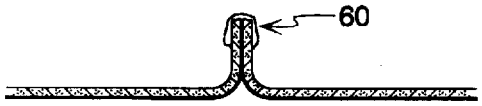
FIG. 8 is a fragmentary cross-sectional view taken along the line 8—8 of FIG. 4.
Figure 9:
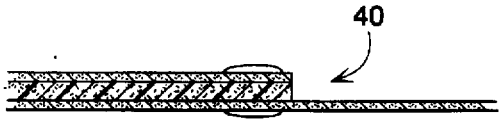
FIG. 9 is a fragmentary cross-sectional view taken along the line 9—9 of FIG. 4.

Turning now to FIGS. 5–9, configuration of the various seams employed in fabrication of garment 10 are shown. FIG. 5 shows the seam 18 joining the waistband 12 to the trouser portions. In the preferred embodiment, the support pads 44, 46 extend upwardly to the waistband 12 and are conveniently terminated by stitched seam 18. FIG. 6 shows the joinder of trouser portion 44 to medial panel 20. As shown in FIG. 6, the medial panel 20 is folded over upon itself in the region of seam 22. FIG. 7 shows seam 22 beyond the vicinity of support pad 44. FIG. 8 shows a seam 60 joining the ends of trouser portion 14 together. Seam 60 is shown in FIG. 4, with an adjacent similar seam 62 for trouser portion 16. FIG. 9 shows the seam 40 at a point remote from the joinder with medial panel 20.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Athletic protective undergarment, capable of being worn under a pair of pants, and effective for protecting a wearer's hip and thighs while providing freedom of movement, air circulation and evaporation of perspiration, the undergarment comprising:

a pair of trouser legs of stretchable fabric having four-way stretch characteristics;

at least a pair of pads, each pad comprising a layer of four-way stretchable backing fabric laminated to a four-way stretchable foam substrate, the foam substrate positioned between the backing layer and the trouser legs, the pads effective to protect the wearer's hips and at least portions of the wearer's thighs;

at least one stitched seam for nonremovably attaching the pads to the trouser legs; and the foam substrate being perforated to augment air circulation and cooling of the wearer's skin, the four-way stretch characteristics of the trouser legs, backing fabric and foam substrate permitting the trouser legs, backing fabric and foam substrate to stretch about the same amount when a given tension is applied to the garment.

2. The undergarment of claim 1 wherein the trousers fabric is treated so as to draw perspiration away from the wearer's skin.

3. The undergarment according to claim 1 wherein the backing fabric on the foam is affixed to the trouser legs in a manner effective for positioning the fabric layer to be facing toward a wearer's skin.

4. The undergarment according to claim 3 wherein the trousers extend from a wearer's waist, generally to a wearer's knees.

5. The undergarment according to claim 1 further comprising a waistband, and wherein the pads have an outer edge, with a portion of the outer edge secured to the trousers by a stitched seam which joins the waistband to the trousers.

6. The undergarment according to claim 1 wherein the trousers comprise a pair of trouser legs joined by an intermediate panel means.

7. The undergarment according to claim 6 further comprising a waistband joined to the trousers by a stitched seam, and therein the intermediate panel means comprises a single panel having opposed ends each attached to spaced portions of the waistband.

8. The undergarment according to claim 7 wherein the pads have an outer edge, said attaching means comprises at least five stitched seams, one for joining the waistband to the trousers, two for joining the intermediate panel to the trouser legs and two J-shaped seams for joining portions of the outer edge of the pads to the trouser legs.

9. The undergarment according to claim 8 wherein portions of the outer edges of the pads extend along the waistband and along the intermediate panel.

10. Athletic protective undergarment, capable of being worn under a pair of pants, and effective for protecting a wearer's hip and thighs while providing freedom of movement, air circulation and evaporation of perspiration, the undergarment comprising:

a pair of trouser legs of stretchable fabric having four-way stretch characteristics;

at least a pair of pads each pad comprising a layer of four-way stretchable fabric laminated to a four-way stretchable foam substrate, the foam substrate positioned between the backing layer and the trouser legs, the pads effective to protect the wearer's hips and at least portions of the wearer's thighs;

at least one stitched seam at about the perimeter of the pad and backing fabric for nonremovably attaching the pads and backing fabric to the trouser legs; and the foam substrate being perforated to augment air circulation and cooling of the wearer's skin, the four-way stretch characteristics of the trouser legs, backing fabric and foam substrate permitting the trouser legs, backing fabric and foam substrate to stretch about the same amount when a given tension is applied to the garment.

11. The undergarment according to claim 10 wherein the trousers comprise a pair of trouser legs joined by an intermediate panel means extending from the waistband.

12. The undergarment according to claim 11 wherein the intermediate panel means has a pair of opposed edges, and the pads each have an outer edge, the undergarment further comprising a pair of stitched seams for joining edges of the intermediate panel and portions of the outer edges of the pads to respective trouser legs and a second pair of stitched seams having a J-shape, joining other portions of the outer edge of the pads to the trouser legs.

13. Athletic protective undergarment, capable of being worn under a pair of pants, and effective for protecting a wearer's hip and thighs while providing freedom of movement, air circulation and evaporation of perspiration, the undergarment comprising:

a pair of trouser legs of stretchable fabric having four-way stretch characteristics, the trouser legs;

an intermediate panel of stretchable fabric between the trouser legs, the intermediate panel means joined to the trouser legs so as to form trousers therewith;

at least a pair of pads, each pad comprising a layer of four-way stretchable backing fabric and a four-way stretchable foam substrate, the backing fabric laminated to the foam substrate, the pads effective to protect the wearer's hips and at least portions of the wearer's thighs;

at least one stitched seam at about the perimeter of the pad and backing fabric for nonremovably attaching the pads to the trouser legs;

the foam substrate being perforated to augment air circulation and cooling of the wearer's skin, the four-way stretch characteristics of the trouser legs backing fabric and foam substrate permitting the trouser legs backing fabric and foam substrate to stretch about the same amount when a given tension is applied to the garment.

14. The undergarment according to claim 13 wherein the intermediate panel means has a pair of opposed edges, and the pads each have an outer edge, the undergarment further comprising a pair of stitched seams for joining edges of the intermediate panel and portions of the outer edges of the pads to respective trouser legs and a second pair of stitched seams having a J-shape, joining other portions of the outer edge of the pads to the trouser legs.

15. The undergarment according to claim 13 wherein the backing fabric on the foam is affixed to the trouser legs in a manner effective for positioning the fabric layer to be facing toward a wearer's skin.

16. The undergarment according to claim 13 further comprising a waistband, and wherein the pads have an outer edge, with a portion of the outer edge secured to the trouser legs by a stitched seam which joins the waistband to the trouser legs.

* * * * *

UNITED STATES PATENT AND TRADEMARK OFFICE

CERTIFICATE OF CORRECTION

PATENT NO. : 5,689,836
DATED : Nov. 25, 1997
INVENTOR(S) : Fee et al

It is certified that error appears in the above-identified patent and that said Letters Patent is hereby corrected as shown below:

In col. 3, line 61, after "components" insert -- in --.

Signed and Sealed this

Sixteenth Day of February, 1999

*Attest:*

*Acting Commissioner of Patents and Trademarks*

*Attesting Officer*